United States Patent [19]

Sullivan

[11] 4,076,305

[45] Feb. 28, 1978

[54] KNOCK-DOWN MOBILE PICNIC TABLE AND BENCH ASSEMBLY

[75] Inventor: Dwayne Sullivan, Markedtree, Ark.

[73] Assignee: Lawrence Peska Associates Inc., New York, N.Y.

[21] Appl. No.: 782,514

[22] Filed: Mar. 29, 1977

[51] Int. Cl.[2] ..... A47B 3/06

[52] U.S. Cl. ..... 297/157; 108/99; 108/111

[58] Field of Search ..... 297/157, 159, 158, 121; 108/111, 153, 99, 100; 248/129; 16/47, 29, 30, 40; 182/151; 280/30, 87.05, 47.13 R, 79.1

[56] References Cited

U.S. PATENT DOCUMENTS

| | | | |
|---|---|---|---|
| D. 171,751 | 3/1954 | Curtis | 297/157 X |
| 2,816,771 | 12/1957 | Hunt | 280/47.13 R |
| 2,926,794 | 3/1960 | Karoff | 108/99 |
| 3,101,061 | 8/1963 | Amend | 297/157 X |
| 3,300,245 | 1/1967 | Rumble | 297/157 |
| 3,514,154 | 5/1970 | Kotler | 297/159 |
| 3,580,601 | 5/1971 | Miles | 280/47.13 R |
| 3,758,152 | 9/1973 | Lake | 297/157 |

*Primary Examiner*—James T. McCall

[57] ABSTRACT

A knock-down mobile picnic table and bench assembly includes a pair of leg members each of which has oppositely extending medial bench member support shoulders, a pair of bench members mountable on the shoulders, a ridge member interlockable with the leg members, and a table top positionable on upper table top-support edges of the leg members. Tab elements are formed on the shoulders and table top-support edges of the leg members cooperable with apertures in the bench members and table top to releasably interlock the bench members and table top with the leg members. The ridge member is given a notch adjacent each of its opposed ends. The components may be juxtaposed in face-to-face relation such that apertures in the leg members are alignable with the notches in the ridge member and the apertures in the bench members are alignable with apertures in the table top so as to accept fastening means to secure all of the components in a unitary assembly. Wheel assemblies are provided and are adapted to rollably support the stacked assembly.

7 Claims, 2 Drawing Figures

KNOCK-DOWN MOBILE PICNIC TABLE AND BENCH ASSEMBLY

BACKGROUND OF THE INVENTION

The present invention relates to knock-down structures and more particularly to a picnic table and bench assembly which is releasably interlocked in its erected state and can be stacked in face-to-face relation as a rollable unitary assembly in its knock-down state.

Knock-down picnic table and bench assemblies have been known heretofore. However, such structures in their knock-down state were not readily stackable for storage as a unitary assembly nor conveniently movable from one location to another. One such picnic table and bench assembly is disclosed in U.S. Pat. No. 3,300,245 issued Jan. 24, 1967 to F. J. Rumble. The assembly of Rumble employs an arrangement of tabs and cutouts on the components to enable interlocking of the benches, legs and table top. The patent, however, is silent as to the manner by which the knocked down form may be stored and/or transported.

SUMMARY OF THE INVENTION

It is one object of the invention to provide a knock-down picnic table and bench assembly which requires no hardware for erection and which, upon being knocked down, can be easily stacked for storage and transport.

It is another object of the invention to provide a knock-down picnic table and bench assembly which employs an arrangement of apertures, notches and tab elements making it possible to readily erect the structure and to knock-down the unit into an extremely compact and convenient assembly for storage and transport.

Other objects and advantages of the invention will become readily apparent from the following description of the invention.

According to the present invention there is provided a knock-down mobile picnic table and bench assembly comprising in combination: a pair of leg members each of which includes a pair of medial oppositely extending horizontal bench-support shoulders, each of the shoulders having at least one upwardly projecting tab element, an upper table top-support edge surmounting each of the leg members, at least one upwardly projecting tab element integral with each of the table top-support edges, a vertical notch in each of the leg members extending inwardly from the table top-support edge thereof, and a pair of spaced apertures in each leg member adjacent the edge, parallel to and remote from the table top-support edge; an elongated ridge member having a notch formed therein extending inwardly from a longitudinally extending face adjacent each of the opposed ends thereof, the notches being of sufficient width to permit interlocking of the ridge member with the leg members such that the opposed longitudinally extending face is substantially flush with the table top-support edges of the leg members; a pair of elongated bench members each of which includes apertures formed therein of such dimensions and at such locations as to be cooperable with the corresponding tabs on the shoulders of the leg members such that the bench members may be mounted in releasable interlocking relation with the shoulders; a table top dimensioned so as to be superimposed upon the leg members and having apertures formed therein of such dimensions and at such locations as to be cooperable with corresponding tab elements on the table top-support edges of the leg members, whereby the table top may be mounted in releasable interlocking relation on the leg members; the apertures in the bench members being alignable with corresponding apertures in the table top and the apertures in the leg members being alignable with the notches in the ridge member such that the bench members, leg members, table top and ridge member may be positioned in face-to-face stacked relation to recieve fastening means through the aligned apertures and notches and thereby join such components releasably in a unitary stacked assembly; and a pair of wheel assemblies adapted to rollably support the stacked assembly and be releasably secured to the stacked assembly.

BRIEF DESCRIPTION OF THE DRAWINGS

In order that the invention may be more fully comprehended it will now be described, by way of example, with reference to the accompanying drawings in which.

DETAILED DESCRIPTION OF THE INVENTION

Figure 1:
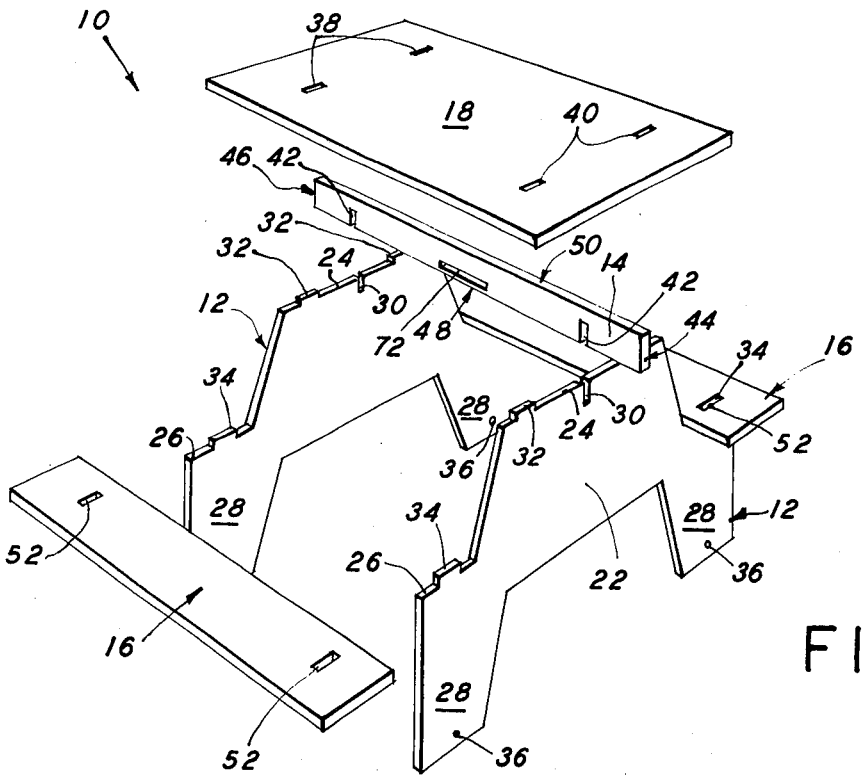
FIG. 1 is an exploded view of the picnic table and bench assembly of the invention.

Referring to the drawings, there is shown a picnic table and bench assembly 10 comprising a pair of leg members 12, an elongated ridge member 14, a pair of bench members 16, a table top 18 and a pair of wheel assemblies 20. All of such members, excluding the wheel assemblies, may be cut from a 4 by 8 foot plywood board to form a unit having a rectangular table top 4 feet long and 28 inches in width. The leg members are 31¼ inches in height by 4 feet in width, and the bench members are 4 feet in length by 10 inches in width. By utilizing such dimensions there will be substantially no waste from the plywood board. However, it will be understood that when desired the dimensions may be varied to nevertheless obtain the benefits of the invention as will become evident from the ensuing description.

Each of the leg members includes an upper section 22, preferably of trapezoidal form, the sides of the trapezoid diverging downwardly from an upper table top-support edge 24 and terminating at an intermediate location. A pair of medial bench-support shoulders 26 extend laterally in opposed directions and a pair of base suppport sections 28 depend from the trapezoidal section. The table top-support edge and shoulders 26 extend in parallel relation. The table top-support edge is given a centrally located notch 30 which extends inwardly of the leg member from such edge. A tab element 32 projects upwardly from edge 24 on each side of notch 30 for a purpose which will become clear. Each of the medial shoulders is given an upwardly projecting tab element 34. At approximately the mid-point of each base support section 28 there is provided an aperture 36.

As can be seen most clearly in FIG. 1 the table top is desirably rectangular in configuration and has formed therein first and second pairs of spaced apertures 38, 40. Each such pair of apertures is alignable with the table top-support edge of one of the leg members and with the corresponding tab elements 32. Thus, it will be seen that in erecting the unit the table top can be juxtaposed over the leg members and mounted thereon in releasable interlocking relation. Prior to so mounting the table top on the leg members ridge member 14 is positioned across the upper edges 24.

The ridge member is elongated and is given a notch 42 therein adjacent each of its opposed ends 44, 46. Notches 42 extend inwardly from the longitudinally extending face 48. The notches are of sufficient width to permit interlocking of the ridge member with the leg members at notch 30 of the leg members. When in its interlocked position the opposed longitudinally extending face 50 lies substantially in the plane of the upper edge 24 so that there will be no interference with the proper mounting of the table top.

Each of bench members 16 are elongated and include apertures 52 therein of such dimensions and located relative to the perimeter of the respective bench member as to be cooperable with tab elements 34 formed on the medial shoulders of the leg elements. The bench members may thus be mounted upon such shoulders in releasable interlocked relation.

Figure 2:
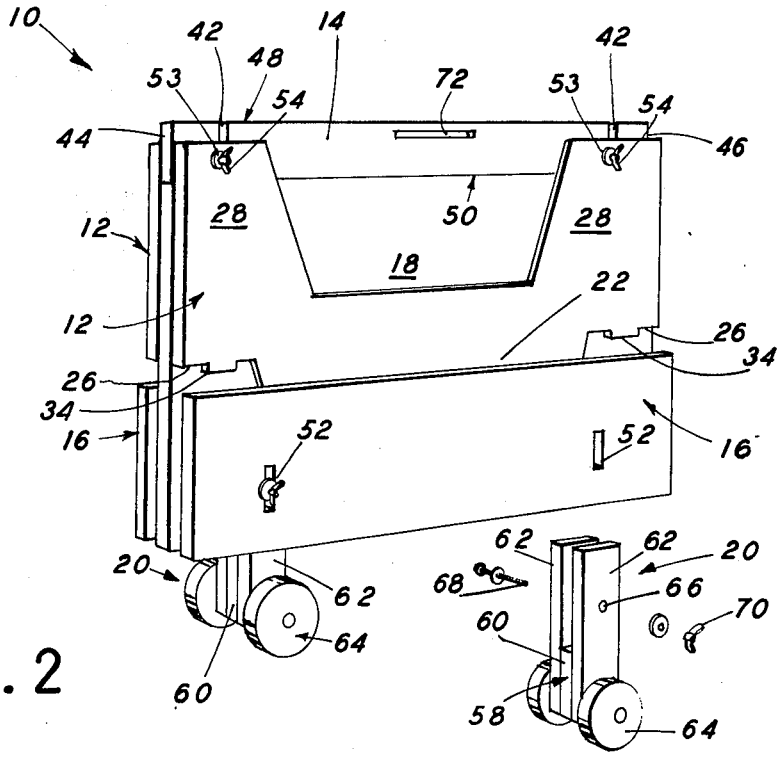
FIG. 2 is a perspective view of the picnic table and bench assembly shown in FIG. 1 in its knocked down state stacked for storage and/or transport.

An important feature of the invention is the use of the apertures in the bench members, table top and leg members and the use of the notches in the ridge member, as well as the trapezoidal upper section of the leg members, to enable stacking of such components in compact face-to-face relation so that they can be releasably secured by fastening means as shown in FIG. 2 for storage and/or transport. Thus, the distance between the apertures in each of the bench members is substantially equal to the distance between the pairs of apertures 38, 40 of the table top and the distance between the notches 42 of the ridge member is substantially equal to the distance between apertures 36 in the base support sections of the leg members. As shown clearly in FIG. 2 of the drawings, the unit, once knocked down, can be stacked by employing the table top as the core of the stacked assembly, positioning the ridge member atop the edge of the table top and then sandwiching them between the leg members which are placed with the upper trapezoidal sections lowermost. The bench members are positioned as the outermost tier across the trapezoidal sections of the leg members. Fastening means such as bolts 53 are inserted through the notches of the ridge member and the aligned apertures of the leg members and wing nuts 54 are tightened on the bolts.

A pair of wheel assemblies 20 are provided to enable the rollable support of the stacked assembly. Each of such wheel assemblies comprises an inverted yoke member 58 which includes a bight portion 60 and a pair of spaced parallel leg elements 62. A wheel sub-assembly 64 is mounted rotatably in the bight portion. The spacing between the leg elements 62 is sufficient so as to receive the lower end of the table top therebetween. Each pair of leg elements is given apertures 66 in horizontal alignment. The wheel assemblies are, as can be seen from FIG. 2, placed beneath the stacked assembly and once apertures 66 are brought into alignment with the apertures in the bench members and with the lowermost aperture of each pair of apertures in the table top a bolt 68 is inserted through the aligned apertures and a wing nut 70 is tightened thereon to thus secure the wheel assemblies to the stacked components of the picnic table and bench assembly. The stacked assembly can thus be rolled from one location to another. It is preferred that the lengths of the bench members, ridge member and table top be substantially the same so as to facilitate storage of the stacked assembly and for convenience in manipulating the stacked assembly on the wheels. The width of the leg elements, measured across the base support sections, should be of substantially equal dimension. It will be observed, from FIG. 2, that by forming the upper section 22 of each leg member (disposed lowermost as viewed in FIG. 2) so as to extend inwardly of the outer edges it has been made possible to nest the leg elements 62 within the stacked assembly to thereby reduce the outer dimensions of the stacked assembly.

For convenience a handle 72 is provided on the ridge member. Manipulation of the stacked assembly on its wheel assemblies is thereby facilitated. As depicted in FIGS. 1 and 2 an elongated aperture in the ridge member is eminently satisfactory as the handle means.

From the foregoing it will be seen that a knock-down picnic table and bench assembly has been disclosed which not only is easily erected without the need for any hardware but which is readily stacked in face-to-face relation in its knocked down state and provided with wheels for storage and mobility. The unique arrangement of the apertures and notches of the component elements enables such compact stacking of the unit.

I claim:

1. A knock-down mobile picnic table and bench assembly comprising in combination:

a pair of leg members each of which includes a pair of medial oppositely extending horizontal bench-support shoulders, each of said shoulders having at least one upwardly projecting tab element, an upper table top-support edge surmounting each of said leg members, at least one upwardly projecting tab element integral with each of said table top-support edges, a vertical notch in each of said leg members extending inwardly from the table top-support edge thereof, and a pair of spaced apertures in each said leg member adjacent the edge, parallel to and remote from said table top-support edge;

an elongated ridge member having a notch formed therein extending inwardly from a longitudinally extending face adjacent each of the opposed ends thereof, said notches being of sufficient width to permit interlocking of the ridge member with said leg members such that the opposed longitudinally extending face is substantially flush with the table top-support edges of said leg members;

a pair of elongated bench members each of which includes apertures formed therein of such dimensions and at such locations as to be cooperable with the corresponding tabs on the shoulders of said leg members such that said bench members may be mounted in releasable interlocking relation with said shoulders;

a table top dimensioned so as to be superimposed upon said leg members and having apertures formed therein of such dimensions and at such locations as to be cooperable with corresponding tab elements on the table top-support edges of said leg members, whereby the table top may be mounted in releasable interlocking relation on said leg members;

the apertures in said bench members being alignable with corresponding apertures in said table top and the apertures in said leg members being alignable with the notches in said ridge member such that said bench members, leg members, table top and ridge member may be positioned in face-to-face stacked relation to receive fastening means through the aligned apertures and notches and thereby join such components releasably in a unitary stacked assembly; and a pair of wheel assemblies adapted to rollably support the stacked assembly and be releasably secured to said stacked assembly.

2. A picnic table and bench assembly according to claim 1, including first and second pairs of spaced apertures in said table top alignable respectively with the table top-support edges of said leg members, the distance between the apertures in each of said bench members being substantially equal to the distance between said pairs of apertures in said table top, and the distance between the notches of said ridge member being substantially equal to the distance between the apertures of said leg members.

3. A picnic table and bench assembly according to claim 1, including handle means on said ridge member.

4. A picnic table and bench assembly according to claim 3, wherein said handle means comprises an elongated aperture formed in said ridge member.

5. A picnic table and bench assembly according to claim 1, wherein said table top, bench members and ridge member are of substantially equal length and said leg members each comprise an upper generally trapezoidal section the upper edge of which constitutes said table top-support edge, the sides of said trapezoidal section diverging downwardly and terminating in a juncture with said opposed medial shoulders, a pair of base support sections depending from said trapezoidal section, the said trapezoidal section being so proportioned that when the assembly is in stacked unitary relation the table top and ridge member form the core of the assembly, said leg members being positionable on opposed faces of said table top and said bench members being positionable in overlying relation to the trapezoidal sections of said leg members.

6. A picnic table and bench assembly according to claim 5, wherein each of said wheel assemblies comprises an inverted yoke member including a bight portion and a pair of spaced parallel leg elements, a pair of wheels being rotatably mounted on said bight portion, the spacing between the leg elements of each said yoke member being sufficient to receive the lower end of the table top therein, each said pair of leg elements having aligned apertures therein alignable with the corresponding apertures in said bench members and table top and dimensioned to receive fastening means therethrough.

7. A picnic table according to claim 1, including a pair of said tab elements on said table top-support edge of each leg member formed on opposite sides of said vertical notch.

* * * * *